US005775387A

United States Patent [19]

Kaneko

[11] Patent Number: 5,775,387

[45] Date of Patent: Jul. 7, 1998

[54] CONTAINER FILLING SYSTEM HAVING FILL-PIPE WITH AN EXTENDED SEALING MEMBER FOR REDUCING MIXING OF PRODUCT AND AIR DURING CONTAINER FILLING

[75] Inventor: Yutaka Kaneko, Wheeling, Ill.

[73] Assignee: Tetra Laval Holdings & Finance, S. A., Pully, Switzerland

[21] Appl. No.: 707,944

[22] Filed: Sep. 10, 1996

[51] Int. Cl.[6] ..... B67C 3/26

[52] U.S. Cl. ..... 141/263; 141/146; 141/152; 141/164; 141/286

[58] Field of Search ..... 141/59, 140, 146, 141/152, 264, 284, 286, 86, 392, 263; 239/569, 570.5, 583

[56] References Cited

U.S. PATENT DOCUMENTS

| | | | |
|---|---|---|---|
| 194,726 | 8/1877 | Ross . | |
| 1,621,638 | 3/1927 | McIntyre et al. . | |
| 2,213,998 | 9/1940 | Sifkovitz . | |
| 2,608,335 | 8/1952 | Rohdin . | |
| 2,651,445 | 9/1953 | Kennedy, Jr. . | |
| 2,710,121 | 6/1955 | Rees . | |
| 2,723,069 | 11/1955 | Shanhouse et al. . | |
| 2,763,416 | 9/1956 | Wormser . | |
| 2,839,094 | 6/1958 | Reno . | |
| 2,874,734 | 2/1959 | Luckock et al. . | |
| 2,913,016 | 11/1959 | Luther . | |
| 2,923,272 | 2/1960 | Emmert . | |
| 3,005,473 | 10/1961 | Ring . | |
| 3,106,231 | 10/1963 | Lehmann . | |
| 3,330,310 | 7/1967 | Heffelfinger et al. . | |
| 3,402,857 | 9/1968 | Ecklund et al. . | |
| 3,460,590 | 8/1969 | Robbins | 141/7 |
| 3,486,840 | 12/1969 | Burton et al. . | |
| 3,924,666 | 12/1975 | Raison . | |
| 4,050,473 | 9/1977 | Cho . | |
| 4,073,307 | 2/1978 | Royce . | |
| 4,074,836 | 2/1978 | Muller, Jr. | 222/564 |
| 4,185,669 | 1/1980 | Jevakohoff | 141/59 |
| 4,235,265 | 11/1980 | Feliks | 141/85 |
| 4,537,335 | 8/1985 | Rangwala et al. | 222/496 |
| 4,606,382 | 8/1986 | Biller et al. | 141/1 |
| 4,749,010 | 6/1988 | Petell | 141/59 |
| 4,792,068 | 12/1988 | Trygg | 222/512 |
| 4,815,666 | 3/1989 | Gacka et al. | 239/697 |
| 5,287,997 | 2/1994 | Rodrigue et al. | 222/380 |
| 5,375,813 | 12/1994 | Rozinsky | 251/333 |

*Primary Examiner*—David J. Walczak
*Assistant Examiner*—Timothy L. Maust
*Attorney, Agent, or Firm*—Michael A. Catania

[57] ABSTRACT

A filling system for filling a container through an open end thereof is set forth. The filling system comprises a fill-pipe having an inlet for receiving a liquid product and an outlet through which the liquid product can be dispensed into the open end of the container when the container is disposed below the outlet. A valve sealing member is disposed within the fill-pipe. The valve sealing member comprises a body portion and a closure portion. The closure portion is dimensioned to seal the outlet of the fill-pipe. An actuator is employed for moving the valve sealing member between a first position in which the closure portion seals the outlet of the fill-pipe and a second position in which the valve sealing member is extended from the outlet of the fill-pipe and into the interior of the container to cause the closure portion to disengage from the outlet. The valve sealing member is dimensioned to displace a substantial portion of air from the interior of the container while also allowing the liquid product to exit the outlet of the fill-pipe. Preferably, the body portion of the valve sealing member has a length that is at least about as long, if not longer than, the height of the liquid product that is ultimately dispensed into the container. Also, the body portion is preferably comprised of a plurality of flow channels that have sidewalls defined by air displacement fins.

11 Claims, 10 Drawing Sheets

CONTAINER FILLING SYSTEM HAVING FILL-PIPE WITH AN EXTENDED SEALING MEMBER FOR REDUCING MIXING OF PRODUCT AND AIR DURING CONTAINER FILLING

TECHNICAL FIELD

The present invention relates to a filling system for dispensing a liquid product into a container. More specifically, the present invention relates to a container filling system having an extended sealing member that extends and controls product flow from a fill-pipe for reducing mixing of product and air during the container filling process.

BACKGROUND

Packaging machines are known that integrate the various components necessary to fill and seal a container into a single machine unit. This packaging process, generally stated, includes feeding carton blanks into the machine, sealing the bottom of the cartons, filling the cartons with the desired contents, sealing the tops of the cartons, and then off-loading the filled cartons for shipping.

Trends within the field of packaging machines point toward increasingly high capacity machines intended for rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and titled "Packaging Machine". The machine disclosed in the '812 patent includes a plurality of processing stations, each station implementing one or more processes to form, fill, and seal the containers. Each of the processing stations is driven by one or more servomotors that drive the various components of each of the processing stations.

The increased throughput and decreased size requirements of packagers on their packaging machines have increased the demands that are placed on the fill systems that are employed. Various apparatus and corresponding methods for filling containers, such as gable-top containers, have therefor been devised for these machines. In accordance with one of the more popular filling methods, the container is lifted from a conveyor to a fill pipe by means of a lifting mechanism. The container lifting mechanism gradually lowers the container as product is dispensed through the fill tube. The container then again engages the conveyor where it is transported to a top sealing station. Such a method is utilized in TR/7™ and TR/8™ packaging machines manufactured and available from Tetra Pak, Inc.

Alternatively, the filling and top sealing operations may be performed at a single location within the machine. In such instances, the container may be top sealed after it has been lowered from the fill pipe. Such a method and apparatus are shown and described in the foregoing '812 patent, and, further, in U.S. Ser. No. 08/315,414, filed Sep. 28, 1994, and entitled "Control System For A Packaging Machine".

One problem encountered when attempting to increase the speed with which a container is filled with product relates to the foaming that occurs as a result of air and product mixing in the container. Generally stated, foaming increases as the speed with which the container is filled increases. When foaming is excessive, the product splashes into the sealing areas of the container resulting in improper sealing in subsequent sealing operations and/or contamination of the sealing area resulting in a reduction in the hygiene of the seal than would otherwise be obtained. The rate at which the container may be filled is thus limited by the foaming that occurs for a given fill rate. This problem is particularly problematic when the container filling and sealing occur at the same station within the packaging machine, such a machine being disclosed in the foregoing '812 patent.

SUMMARY OF THE INVENTION

A filling system for filling a container through an open end thereof is set forth. The filling system comprises a fill-pipe having an inlet for receiving a liquid product and an outlet through which the liquid product can be dispensed into the open end of the container when the container is disposed below the outlet. A valve sealing member is disposed within the fill-pipe. The valve sealing member comprises a body portion and a closure portion. The closure portion is dimensioned to seal the outlet of the fill-pipe. An actuator is employed for moving the valve sealing member between a first position in which the closure portion seals the outlet of the fill-pipe and a second position in which the valve sealing member is extended from the outlet of the fill-pipe and into the interior of the container to cause the closure portion to disengage from the outlet. The valve sealing member is dimensioned to displace a substantial portion of air from the interior of the container while also allowing the liquid product to exit the outlet of the fill-pipe. Preferably, the body portion of the valve sealing member has a length that is at least about as long, if not longer than, the height of the liquid product that is ultimately dispensed into the container. Also, the body portion is preferably comprised of a plurality of flow channels that have sidewalls defined by air displacement fins.

Other objects and advantages of the present invention will become apparent upon reference to the accompanying detailed description when taken in conjunction with the following drawings.

DESCRIPTION OF THE PREFERRED EMBODIMENTS

Figure 1:
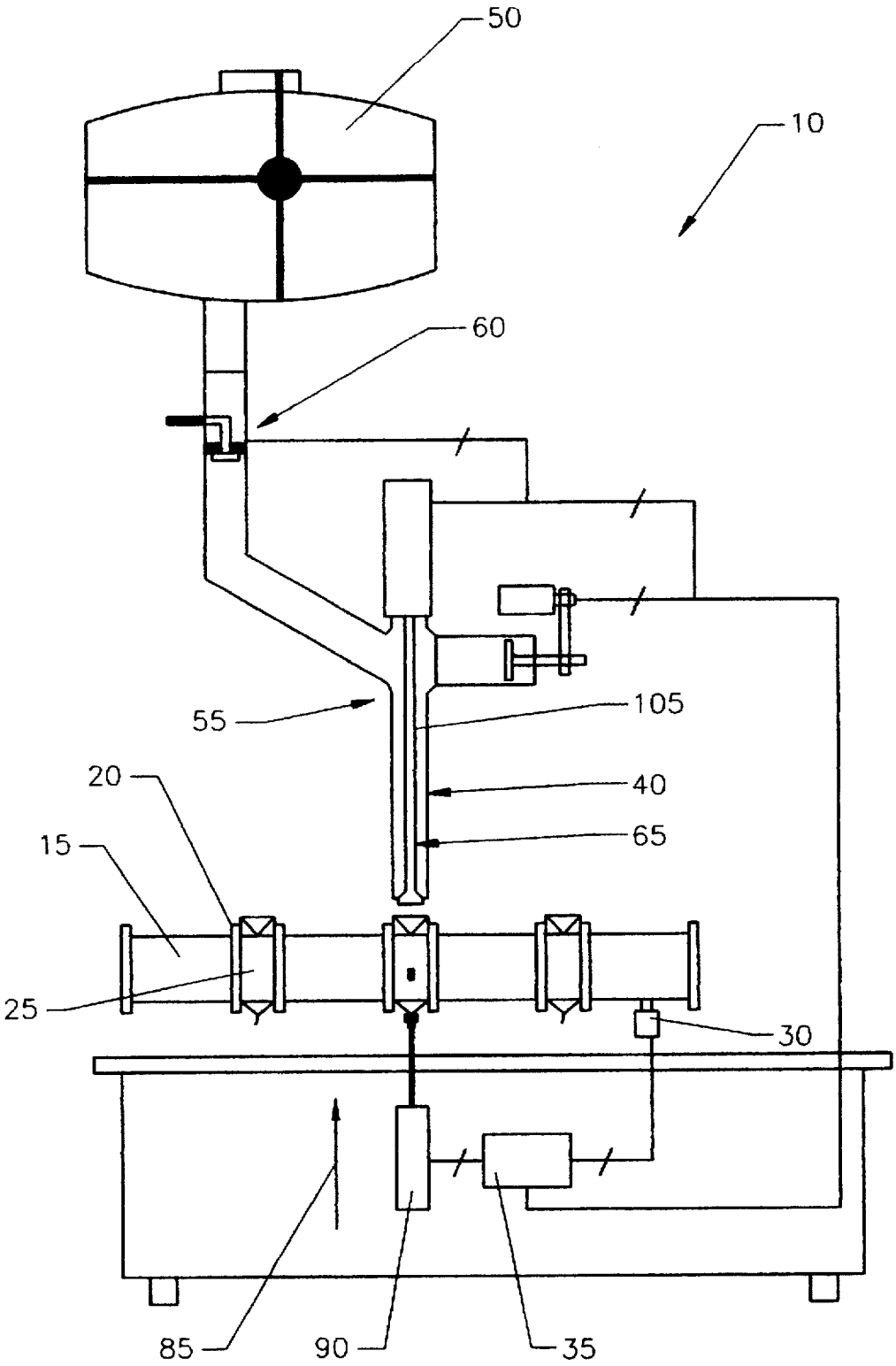
FIG. 1 is a diagrammatic illustration of one embodiment of a fill constructed in accordance with the teachings of the present invention.

FIG. 1 is a basic diagrammatic view of one of the many types of filling machines that may utilize a filling system, shown generally at 10, having a sealing member and associated structures constructed and operated in the manner described below. As shown in FIG. 1, a conveyor 15 having a plurality of carton support members 20 is driven by, for example, a motor. The support members 20 each support a single, open topped container 25 that has its bottom sealed. The conveyor 15 is driven by motor 30 under the control of, for example, a programmable control system 35, or the like, to present the containers 20 successively below the outlet of a fill pipe assembly 40 of the fill system 10.

A storage or balance tank 50 containing a liquid product is connected to provide a flow of the liquid product through a flow control system 55. The flow control system, generally stated, comprises an inlet valve 60, an umbrella valve assembly 65, a pump mechanism 70, and the fill pipe assembly 40. The inlet valve 60 and umbrella valve assembly 65 are controlled to control the flow of the liquid product into and from the pump chamber of the pump mechanism. The pump mechanism 70 may be any type of pump mechanism, such as one disclosed in U.S. Pat. No. 4,877,160, which patent is incorporated by reference. The pump mechanism 70 may be driven, for example, by a servomotor under the direction of the programmable control system 35.

As illustrated, the containers 25 are successively brought below the outlet of the fill-pipe for filling with the liquid product. There are a number of ways to dispense the liquid product into the containers 25. For example, each container may be lifted in the direction of arrow 85 so that the outlet end of the fill-pipe and the open top of the container are proximate one another. This lifting may be done using a lifting mechanism 90 that executes a motion profile under the direction of, for example, the programmable control system 35. One such lifter mechanism and corresponding carton gripping mechanism are disclosed in U.S. Ser. No. 08/315,410, filed Sep. 28, 1994 and U.S. Ser. No. 08/315,410, also filed Sep. 28, 1994. The flow control system 55 is then operated to fill the container 25 with liquid product as the container 25 is lowered from the nozzle by the container lifter mechanism 90. The container 25 may also be top-sealed at the illustrated station using an ultrasonic sealing mechanism such as the one shown and described in U.S. Ser. No. 08/315,412, filed Sep. 28, 1994, and incorporated herein by reference.

It should be clear from the following description, however, that a lifter mechanism need not be employed with an umbrella valve assembly constructed in the manner set forth below. Rather, the containers 25 may remain at the same level of the conveyor 15 throughout the filling, sealing, and transport processes.

Figure 2:
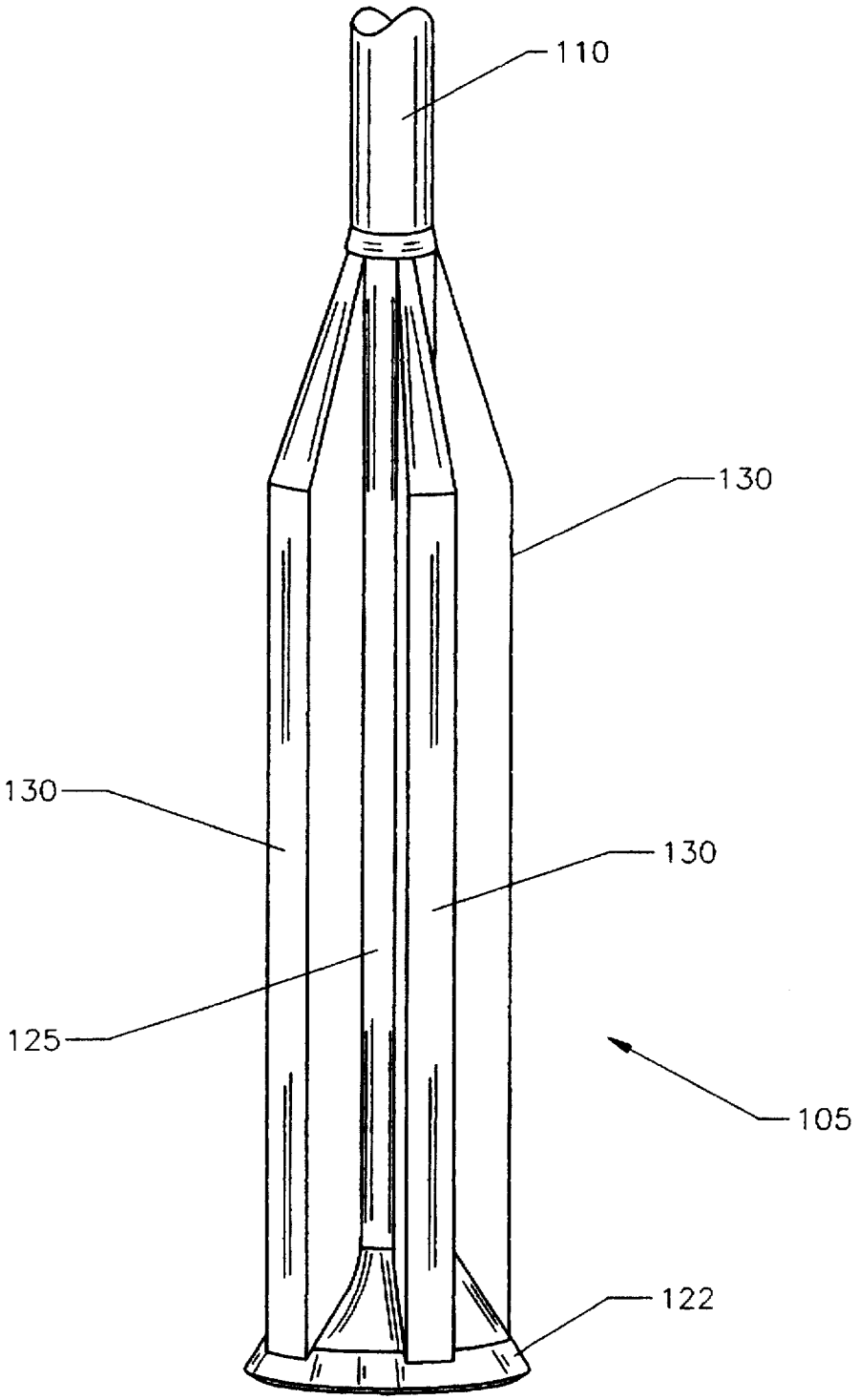
FIGS. 2–4 are various views of one embodiment of a valve sealing member for use in a fill system in accordance with the teachings of the present invention.
Figure 3:
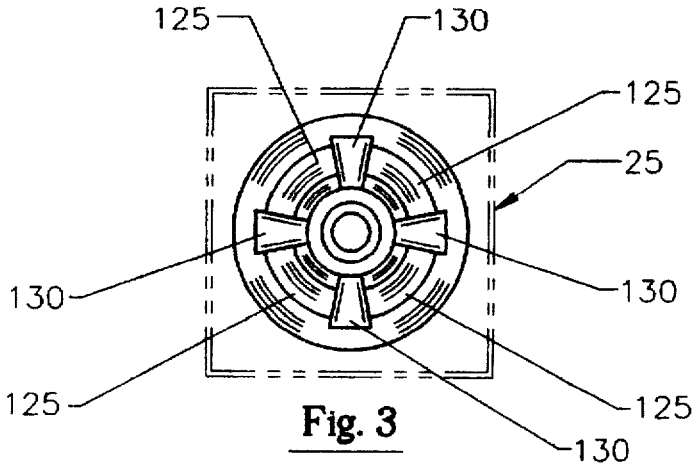
Figure 4:
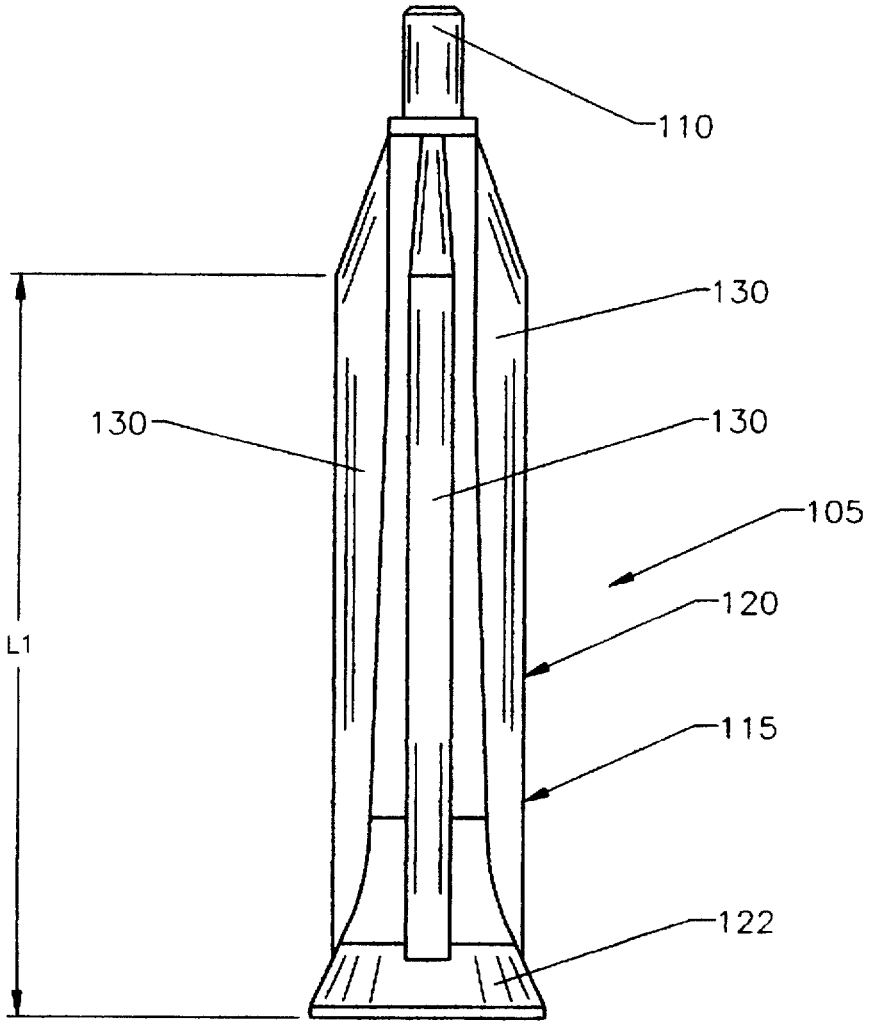

FIG. 2 is a perspective view of one embodiment of an umbrella valve sealing member 105 for use in the umbrella valve assembly 65 of the foregoing fill system 10 and FIGS. 3 and 4 are top and side views of the same, respectively. As illustrated, the umbrella valve sealing member 105 comprises a valve rod 110 formed from, for example, stainless steel, and an extended valve cone member 115 having a body formed from, for example, high density polyethylene. The extended valve cone member 115 comprises a body portion 120 and a closure portion 122. The body portion 120 preferably has an exterior diameter that is just slightly less than the interior diameter of the corresponding fill-pipe and has a length L1 that is at least as long as the height of the level of liquid to which a container is to be filled. Such dimensions are preferable but, however, are not absolutely mandatory, the dimensions being such as to displace a substantial portion of air from the interior portion of a container that is to be filled when the extended valve cone member 115 is extended into the interior of the container. For example, the valve member may be dimensioned to displace about 25% of the air in the container. A plurality of flow channels 125 are disposed in the body portion 120 of the extended valve cone member 105. The flow channels 125 are preferably positioned to align with the corners of the container 25 that is to be filled during the filling process. In the illustrated embodiment, the flow channels 125 are designed to be aligned with the four corners of a rectangular container, such as a gable-top container. The sides of the flow channels 125 are defined by air displacement fins 130 that, as will be clear from the discussion below, assist in displacing air from the interior of the container during the filling process to thereby inhibit the mixing of liquid product and air. The air displacement fins 130 extend radially from the center of the body portion 120 to a diameter that is slightly less than the interior diameter of the fill-pipe in which it is disposed. Additionally, the air displacement fins 130 preferably taper to a diminished diameter proximate the valve rod 110. The flow channels 125 flare to an increased diameter proximate a flared closure portion 122. The flared closure portion 122, as will be described in further detail below, is shaped and dimensioned to engage a corresponding valve seat of the fill-pipe.

Figure 5:
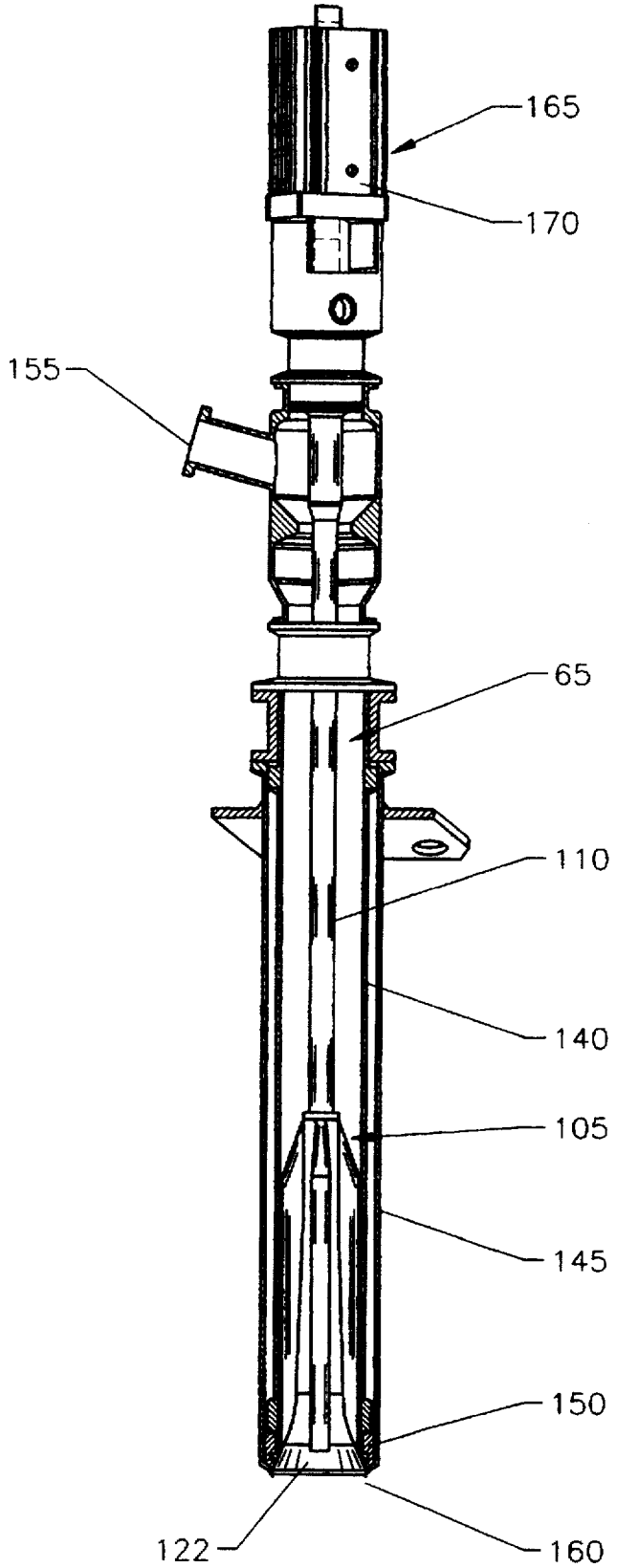
FIG. 5 is a partial, cross-sectional view of one embodiment of an umbrella valve assembly and corresponding fill-pipe assembly that are constructed in accordance with the teachings of the present invention.

One embodiment of the present invention showing the relationships between the umbrella valve assembly 65 and the components of the fill pipe assembly 40 are shown in FIG. 5. As illustrated, the fill pipe assembly 40 includes a primary fill pipe 140 that is concentrically disposed within an insulating pipe 145. The region between the insulating pipe 145 and primary fill pipe 140 is sealed at an upper portion at, for example, a joint at which the pipes 140 and 145 are connected to one another, and at a lower end by a sealing collar 150 or a product scraper, such as a scraper formed in accordance with the teachings of U.S. Ser. No. (Not available at the time of filing of this application) filed Aug. 28, 1996,(Attorney Docket No. 10858US01). Such an arrangement assists in reducing the likelihood that condensation at the exterior of the fill pipe assembly will enter the container therebelow when the system is used to dispense a cool product, such as refrigerated milk. The region between pipes 140 and 145 may be air or another type of thermal insulating material. Additionally, the scraper functions to remove residual product that may otherwise accumulate on the sealing end 122 of the umbrella valve sealing member 105.

The primary fill pipe 140 accepts liquid product through an inlet pipe 155. Flow of the liquid product from the fill pipe 140 and into a container is principally controlled by the movement of the sealing member 105 of the umbrella valve assembly 65.

The umbrella valve assembly, shown generally at 65, controls the flow of the product through the outlet 160 of the fill pipe 140. The assembly 65 includes an actuator 165 disposed proximate the upper portion of the fill tube 140. The actuator 165 for example, may comprise a pneumatically operated cylinder 170 that houses a piston that, in turn, is connected to actuate the valve rod 110 of the umbrella valve sealing member 105. One type of linear actuator suitable for such use is available from Mecman, a division of Rexroth, located in Elk Grove Village, Ill. The umbrella valve sealing member 105 is preferably disposed concentrically within the fill pipe 140. The flared closure portion 122 is disposed proximate the outlet 160 of the fill pipe 140. The flared closure portion 122 engages to cover the outlet 160 to seal off the flow of product from the fill tube 140 when the actuator 165 moves the valve rod 110 of the sealing member 105 to the illustrated position. The actuator 165 may be operated to move the sealing member 105 to a second position in which the sealing member 105 is disengaged from the outlet 160 thereby allowing the product to flow from the fill pipe 140.

Figure 6:
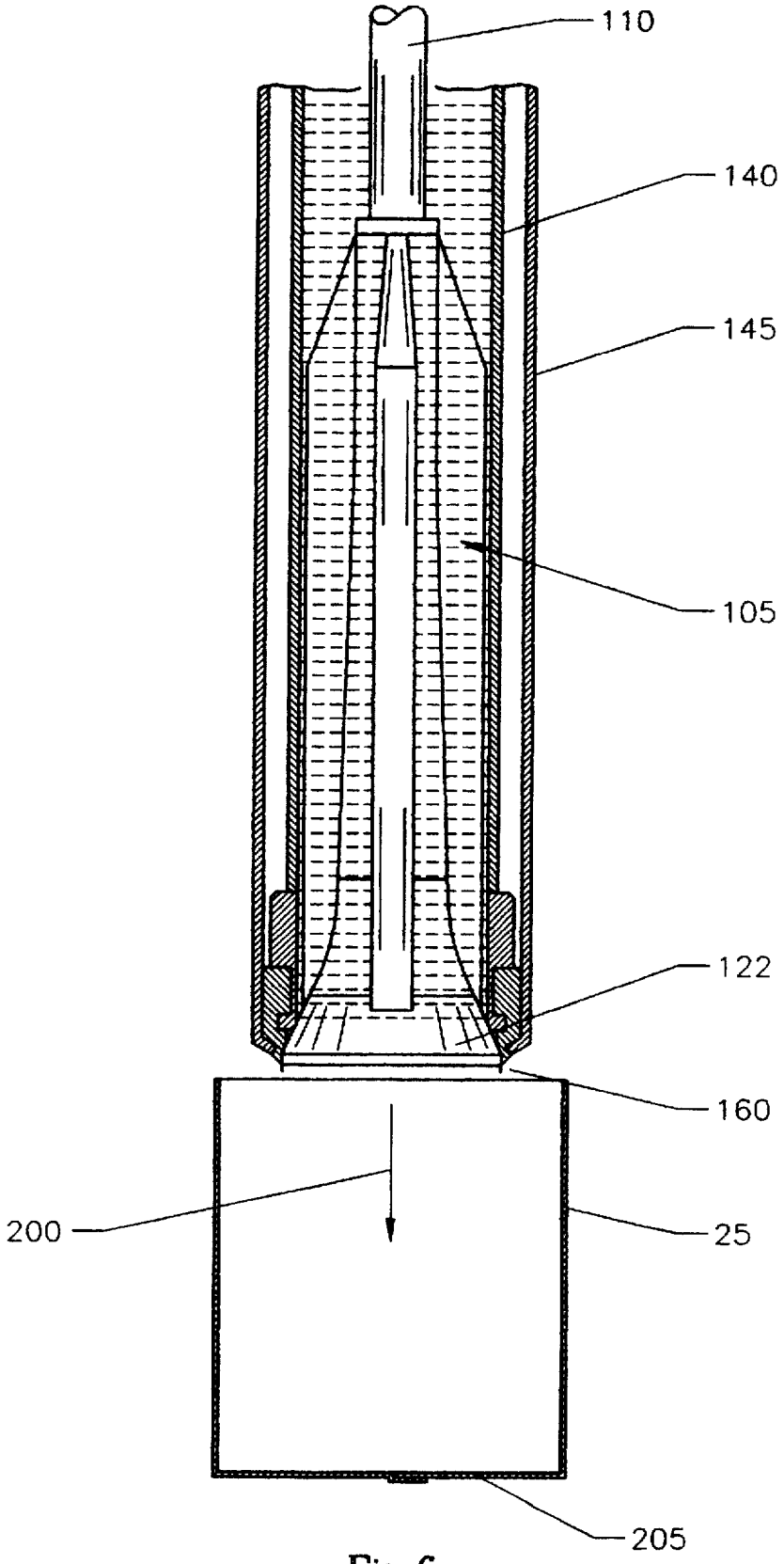
FIGS. 6–10 illustrate the operation of the present invention at various stages within a single filling cycle, FIGS. 8–10 illustrating the various modes of relative motion between the container and the valve sealing member that may be employed.
Figure 7:
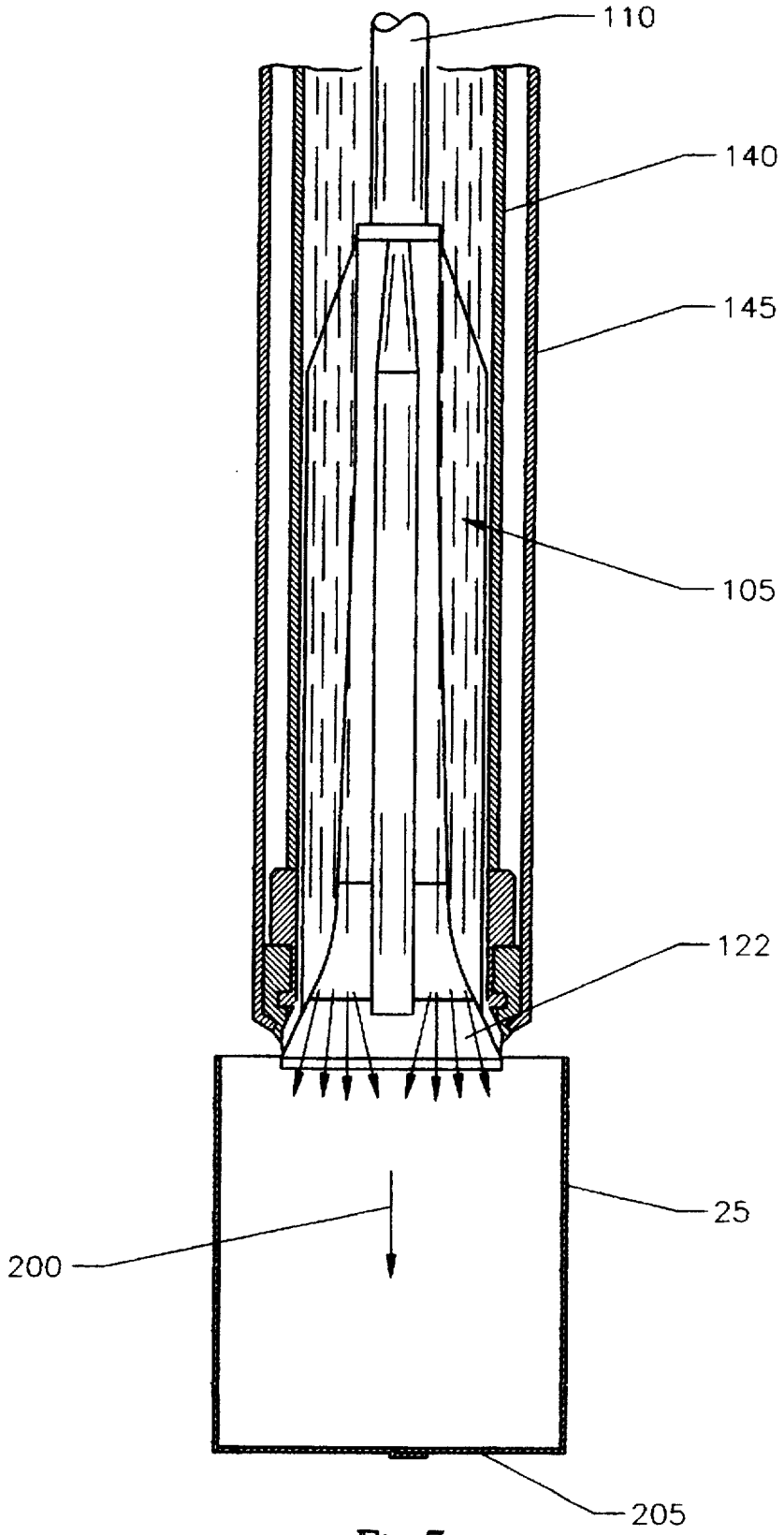

Operation of the umbrella valve assembly 65 of the fill system 10 can be described with reference to FIGS. 6–10. As illustrated in FIG. 6 the outlet 160 of the fill-pipe 140 is brought proximate the open top of the container 25 to begin a filling cycle. The actuator 165 is then activated by, for example, the control system 35 to drive the umbrella valve sealing member 105 in the direction shown by arrow 200 into the container 25 so that the flared sealing portion 122 is proximate, and, preferably contacts the bottom wall 205 of the container 25 in the manner illustrated in FIGS. 7 and 8. As the umbrella valve sealing member 105 is driven to the illustrated position, the flared sealing portion 122 disengages from the outlet 160 of the fill-pipe 140 thereby allowing product to begin flowing from the fill-pipe 140 into the container 25. Additionally, the valve sealing member 105 displaces a substantial portion of air from the interior of the container 25 that would otherwise be allowed to mix with the product as the product is dispensed into the container. Since the fluid flow channels 125 of the illustrated embodiment are outwardly flared from top to bottom, the effective fluid flow area of the outlet 160 is gradually increased as the umbrella sealing member 105 is driven toward the bottom of the container 25. As a result, less product flows from the outlet 160 during the initial move of the umbrella sealing member 105 than in the latter stages of the move toward the von of the container. Additionally, the flared construction of the fluid flow channels 125 and the relative positions thereof assist in directing the flow of product toward the corners of the container 25 and reduce the product velocity.

As the umbrella sealing member 105 is driven to its position proximate the bottom of the container 25 it displaces a corresponding volume of air from the container interior. Since there is a reduced volume of air within the interior of the container 25 there is a corresponding reduction in the mixing of product and air during the filling cycle. As such, the product flow rate can be increased without a corresponding increase in the problems associated with air/product mixing.

Figure 8:
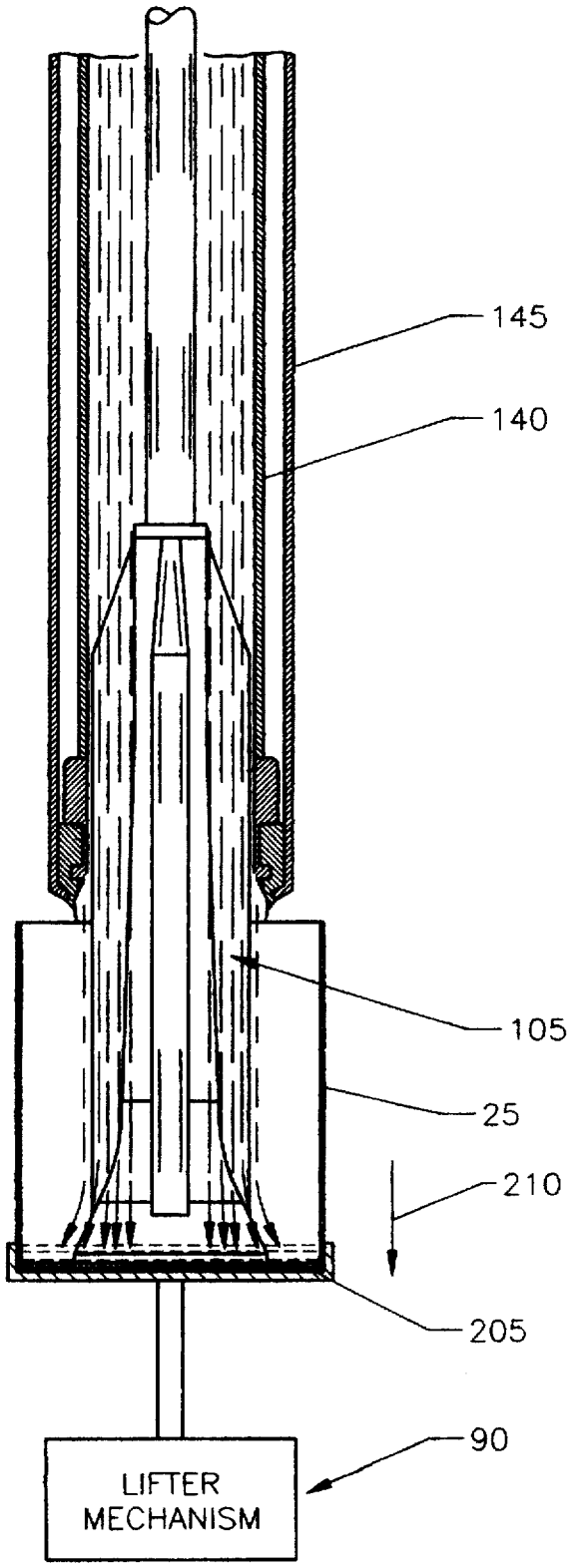
Figure 9:
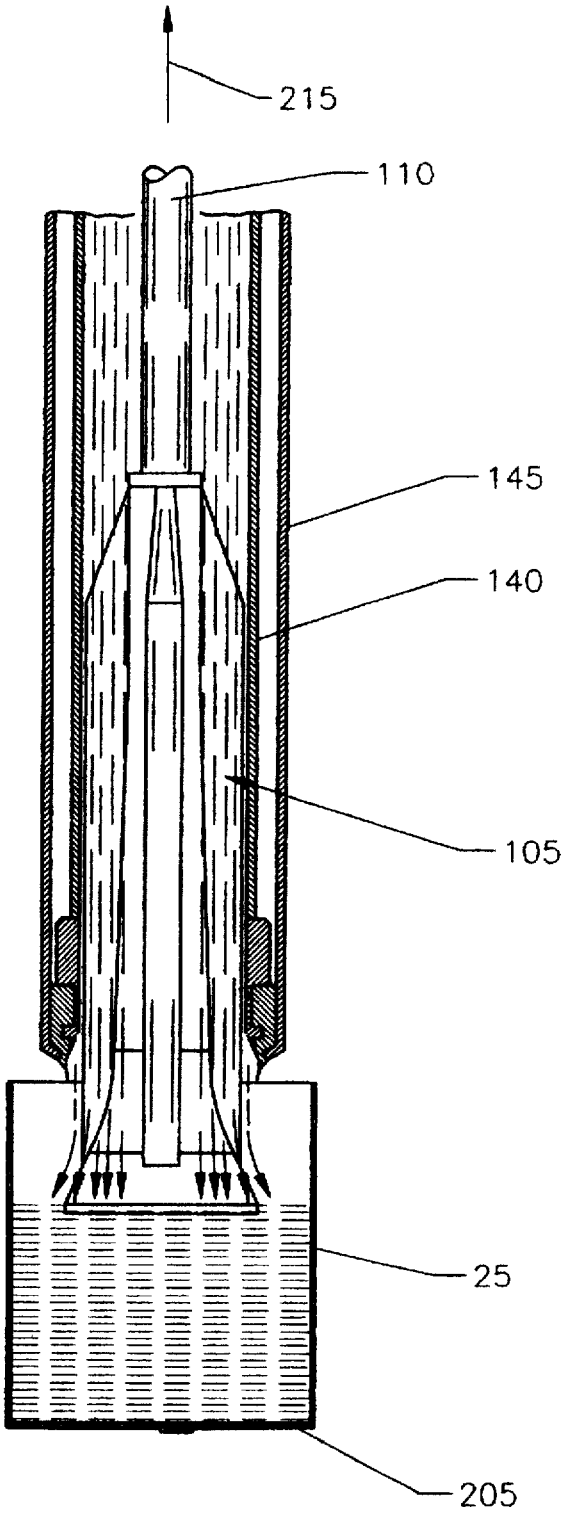
Figure 10:
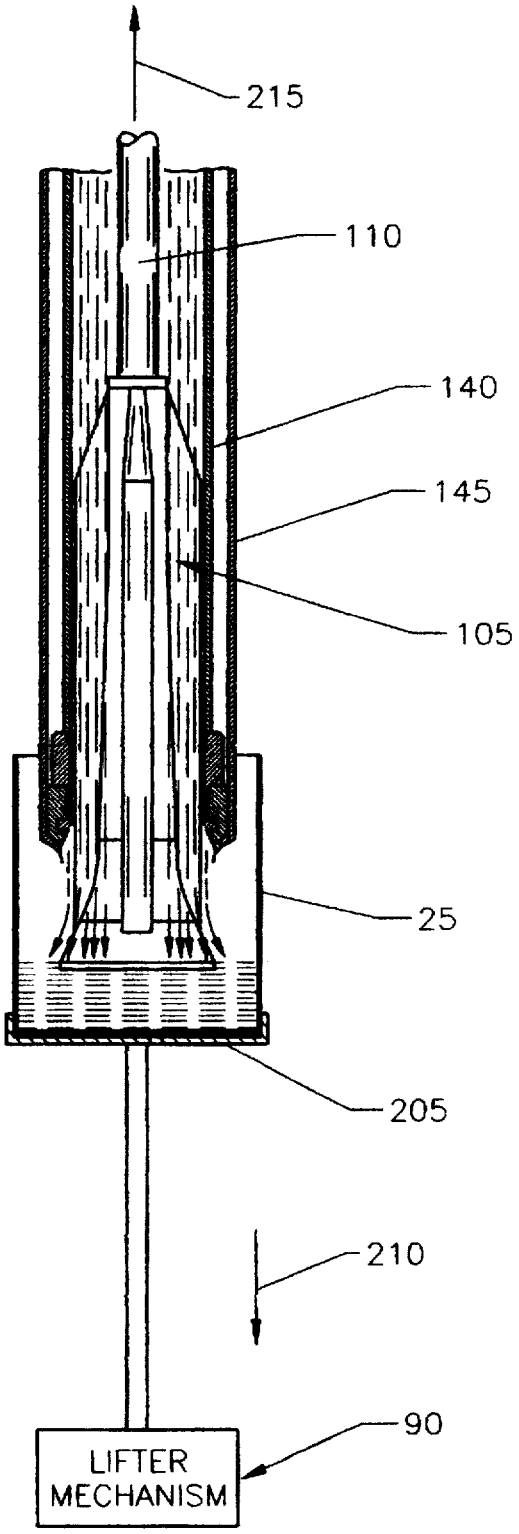

As product is dispensed through the outlet 160, the container 25 and bottom of the umbrella sealing member 105 are moved away from one another while maintaining the bottom of the umbrella sealing member 105 a slight distance below the surface of the liquid product present in the container 25. This relative motion can be implemented in one of at least three different manners. First, the umbrella sealing member 105 may be held stationery while the container 25 is lowered in the direction of arrow 210 by, for example, the lifter mechanism 90 under the control of, for example, the control system 35. Such an arrangement is illustrated in FIG. 8. Second, the container 25 may remain stationary as the actuator 165 gradually moves the umbrella sealing member 105 upward in direction of arrow 215 under the control of, for example, the control system 35. Such an arrangement is illustrated in FIG. 9. Third, both the container 25 and the umbrella sealing member 105 can be moved away from one another in a controlled fashion to implement the desired motion profile. Such an arrangement is illustrated in FIG. 10.

Figure 11:
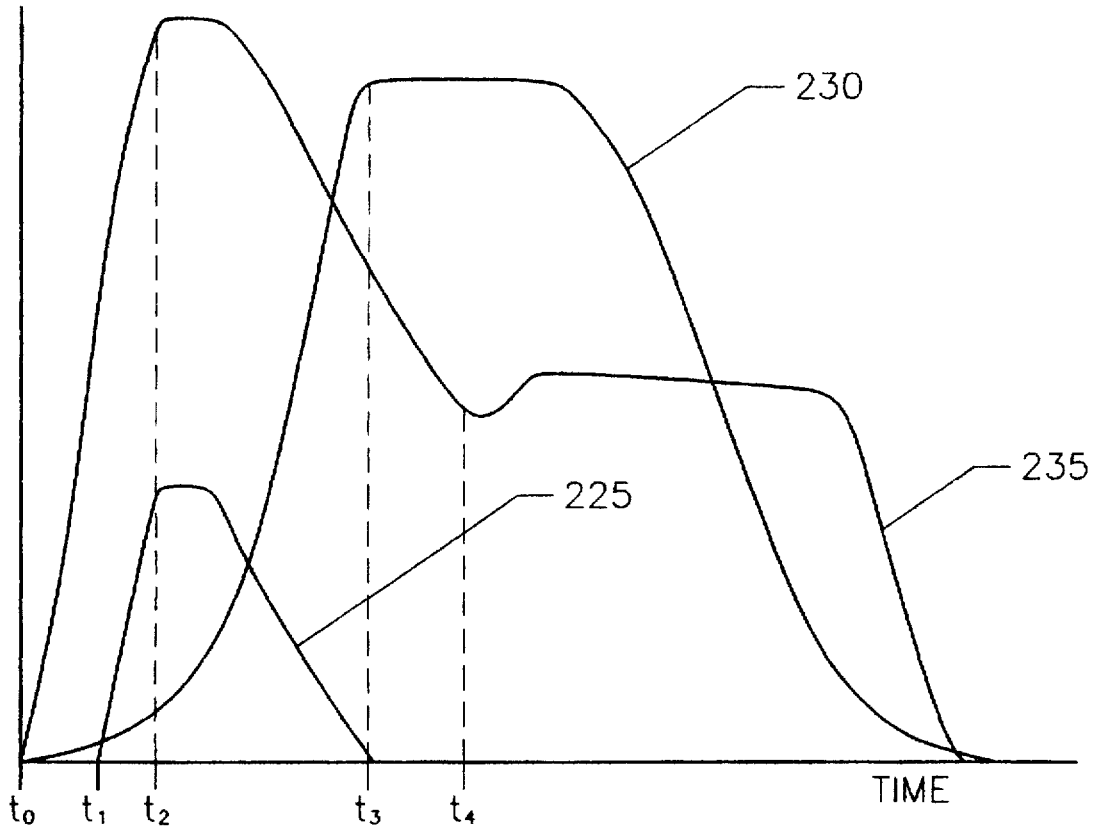
FIG. 11 illustrates an exemplary motion profile that may be used to operate the disclosed apparatus.

FIG. 11 illustrates an exemplary motion profile that may be used to operate the disclosed apparatus. The motion profile may be stored within the control system 35 which, in turn, provides the requisite signals to the various components for execution thereof. The motion profile of FIG. 11 shows generally the relative operation between the umbrella sealing member 105, shown by curve 225, the filling pump mechanism 70, shown by curve 230, and the lifter mechanism 90, shown by curve 235.

As illustrated, the overall cycle begins at time $t_0$ to with the filling pump mechanism 70 beginning a forward stroke to urge liquid product from its pump chamber into the fill-pipe 140 and the lifter mechanism 90 raising the container 25 toward the fill-pipe 140. At time $t_1$, the umbrella sealing member 105 is driven to its extended position until the lifter mechanism 90 and the sealing member 105 reach their maximum travel at time $t_2$. Both the lifter mechanism 90 and the sealing member 105 remain at the maximum travel position for a brief dwell time, after which, the sealing member 25 begins to be retracted into the fill-pipe 140 and the lifter mechanism 90 begins to lower the container 25 from the fill-pipe 140. As noted previously, it is preferable that the relative motion between the retraction of the sealing member 105 and the lowering of the container 25 be coordinated so that the lower sealing portion of the sealing member 105 remains slightly below the level of the liquid in the container at any given instant.

At time $t_3$, the sealing member 105 is fully retracted into the fill-pipe 140 and the sealing portion 122 engages and seals the outlet 160. Also at this time, the filling pump mechanism 70 has ceased its forward dispensing stroke and remains at its maximum forward stroke position for a brief dwell time.

In the exemplary embodiment of the motion profile illustrated here, the lifter mechanism 90 continues to lower the container 25 until time $t_4$, at which time it urges the container 25 upward to a position in which it can be top-sealed by, for example, an ultrasonic carton sealer disposed at the same location as the filling station. The lifter mechanism 90 maintains the container 25 in this position until sealing is completed, after which the container 25 is lowered to its initial level.

Although the present invention has been described with reference to a specific embodiment, those of skill in the art will recognize that changes may be made thereto without departing from the scope and spirit of the invention as set forth in the appended claims.

I claim as my invention:

1. A filling system for filling a container through an open end thereof, the filling system comprising:

a fill-pipe having an inlet for receiving a liquid product and an outlet through which the liquid product can be dispensed into the open end of the container when the container is disposed below the outlet;

a valve sealing member disposed within the fill-pipe, the valve sealing member comprising a body portion with a maximum exterior diameter slightly less than the interior diameter of the fill-pipe, the body portion comprising a plurality of flow channels having sidewalls defined by air displacement fins, the valve sealing member further having a closure portion dimension to seal the outlet of the fill-pipe, the body portion and the closure portion having a combined length that is at least about as long as the height of a level of liquid to which the container is to be filled;

an actuator for moving the valve sealing member between a first position in which the closure portion seals the outlet of the fill-pipe and a second position in which the body portion and closure portion are extended from the outlet of the fill-pipe a length approximately equal to the height to which the container is to be filled with liquid product to thereby displace a substantial portion of air from the interior of the container and allow liquid product to exit the outlet of the fill-pipe.

2. A filling system as claimed in claim 1 wherein the plurality of flow channels are each disposed to align with respective corners of the container during filling.

3. A filling system as claimed in claim 1 and further comprising a valve rod disposed for connection between the valve sealing member and the actuator.

4. A filling system as claimed in claim 3 wherein the air displacement fins taper to a diminished degree of extension proximate the valve rod.

5. A filling system as claimed in claim 1 wherein the plurality of flow channels flare outwardly proximate the closure portion.

6. A filling system as claimed in claim 1 and further comprising means for imparting controlled relative movement between the valve sealing member and the container during a filling cycle to relatively move the valve sealing member and the container away from one another as product is dispensed into the container and thereby maintain the closure portion a distance below the surface of the liquid product.

7. A filling system as claimed in claim 6, wherein the means for imparting relative movement comprises the actuator.

8. A filling system as claimed in claim 6, wherein the means for imparting relative movement comprises a container lifter mechanism.

9. A filling system for filling a container through an open end thereof, the filling system comprising:

a fill-pipe having an inlet for receiving a liquid product and an outlet through which the liquid product can be dispensed into the open end of the container when the container is disposed below the outlet;

a valve sealing member disposed within the fill-pipe, the valve sealing member comprising an extended valve cone member having a body portion and a closure portion, the closure portion being dimensioned to seal the outlet of the fill-pipe;

an actuator for moving the valve sealing member between a first position in which the closure portion seals the outlet of the fill-pipe and a second position in which the extended valve cone member is extended from the outlet of the fill-pipe to cause the closure portion to disengage from the outlet, the body portion of the extended valve cone being dimensioned to displace a substantial portion of air from the interior of the container and allow liquid product to exit the outlet of the fill-pipe; and means for imparting relative movement between the valve sealing member and the container during a filling cycle to relatively move the valve sealing member and the container away from one another as product is dispensed into the container and thereby maintain the closure portion a distance below the surface of the liquid product.

10. A filling system as claimed in claim 9, wherein the means for imparting relative movement comprises the actuator.

11. A filling system as claimed in claim 9, wherein the means for imparting relative movement comprises a container lifter mechanism.

* * * * *